United States Patent [19]

Chern

[11] Patent Number: 4,966,017

[45] Date of Patent: Oct. 30, 1990

[54] FIBER CREEL HUMIDIFICATION

[75] Inventor: Terry S. Chern, Richmond, Va.

[73] Assignee: E. I. du Pont de Nemours and Company, Wilmington, Del.

[21] Appl. No.: 404,797

[22] Filed: Sep. 8, 1989

Related U.S. Application Data

[63] Continuation of Ser. No. 215,658, Jul. 6, 1988, abandoned.

[51] Int. Cl.[5] ..... D06B 3/06

[52] U.S. Cl. ..... 68/5 C; 28/285; 34/50; 57/308; 66/125 A

[58] Field of Search ..... 68/5 C; 28/285; 66/125 A; 57/308; 34/50

[56] References Cited

U.S. PATENT DOCUMENTS

| | | | |
|---|---|---|---|
| 955,001 | 4/1910 | Schilde | 68/5 C X |
| 1,534,499 | 4/1925 | Braemer | 34/50 |
| 1,705,212 | 3/1929 | Schwabe | 68/5 C |
| 2,048,749 | 7/1936 | Lydon | 68/5 C X |
| 2,105,088 | 1/1938 | Lydon et al. | 34/50 X |
| 2,166,548 | 7/1939 | Janssen | 34/50 X |
| 2,508,045 | 5/1950 | Seney | 175/183 |
| 3,191,313 | 6/1965 | Moorhouse | 34/52 |
| 3,508,881 | 4/1970 | Hagenauer et al. | 34/50 X |
| 3,869,429 | 3/1975 | Blades | 270/78 |
| 4,523,441 | 6/1985 | Braybrook et al. | 68/5 C |
| 4,643,351 | 2/1987 | Fukamachi et al. | 62/176.6 X |

FOREIGN PATENT DOCUMENTS

| | | | |
|---|---|---|---|
| 109686 | 9/1917 | United Kingdom | 28/285 |

*Primary Examiner*—Philip R. Coe

[57] ABSTRACT

A process and apparatus for supplying never-dried yarns from a humidified creel to maintain a constant and controlled amount of moisture on the yarns and, thereby, assure that the supplied yarns are maintained at a constant quality for further processing.

5 Claims, 3 Drawing Sheets

FIBER CREEL HUMIDIFICATION

The application is a continuation of application Ser. No. 215,658 filed July 6, 1988 and now abandoned.

FIELD OF THE INVENTION

This invention relates to a method and apparatus for maintaining controlled moisture content on wet, never-dried, fibers prior to further processing steps. By this invention, never-dried fibers can be supplied from creel storage and subjected to continued treatments which require the use of wet feed yarns. In this invention, fibers are kept on spools or other packages in a creel enclosure with controlled humidity awaiting further processing and this invention relates to maintaining a controlled humidity in the enclosure.

BACKGROUND AND PRIOR ART

Wet-spun yarns or other yarns requiring controlled heat treatment or immersion in various treating baths are often required to have a certain, controlled, amount of moisture included therein prior to the treatment. The feed for such yarns has often been provided from immersion in water but such is cumbersome and often leads to inconsistent results due to water carried on the exterior of the yarn filaments.

The feed for such yarns can, of course, be provided on-line from wet-spinning manufacture but, because the subsequent treatments are nearly always much slower than the spinning process, on-line wet yarn supply causes a serious fiber production bottleneck.

For some applications in the past, a creel for holding and supplying yarns from several yarn spool sources was used. Before the present invention, however, creels could not successfully be used to supply wet yarns because the amount of moisture on the supply yarns was not constant and that led to interrupted process operation and inconsistent product qualities. For optimum operation of such treatments using wet yarn supplied from creels, the yarn in the creel must be maintained at a constant, controlled, moisture level.

In the manufacture and/or subsequent processing of some yarns, it is necessary to control the moisture content of the yarn (MOY–Moisture On Yarn) to within a certain range. An example of such a process is the manufacture of precursor yarns to make high modulus para-aramid yarns such as those disclosed in European Patent Application 247889, published Dec. 2, 1987. In the manufacture of such yarns, water-swollen precursor yarns are subjected to heat treatment under tension to increase the modulus and maintain a high tenacity in the finished yarn. The maximum benefits of a process such as the one of that European Patent Application are obtained when the yarns are "never-dried", that is, when they are maintained at a controlled, relatively high, moisture content after spinning and prior to being subjected to further treatment. Another example of a process where a certain moisture content in wet feed yarn is important is a process wherein yarns are colored or treated by an imbibition process such as in British Patent 1,438,067. In such a process, it is desirable for precursor yarns to have a certain, controlled, MOY before being placed into the imbibition bath; and in the process of that reference, the wet-spun feed yarns are supplied from immersion.

Before the present invention, in fiber treatment operations subsequent to spooling of never-dried fibers where attempts were made to supply fiber from creels situated in the open, ambient, conditions of the manufacturing facility, the results were unsatisfactory. Packages or spools of fiber which were mounted on the creels were mounted with, generally, a proper and desired MOY, but during the wait for process startup and during the rather lengthy operation of the process, itself, moisture was lost from the several spools in unacceptably large amounts and the moisture was lost in an uneven way such that the fiber treatment operations were conducted on fibers which were too dry and which were of varying moisture content.

SUMMARY OF THE INVENTION

The present invention provides a method and a controlled humidity creel apparatus for maintaining a high yarn moisture content during storage and unwinding comprising mounting packages of never-dried yarn in a creel on package support means comprising a plurality of spindles arranged for unwinding yarn from said packages, maintaining the atmosphere surrounding the packages at a high humidity, and providing a means for unwinding yarn from the packages in the high humidity atmosphere, and subsequently, removing the unwound yarn from that atmosphere. The spindles are mounted in an enclosure means for providing at least a partial envelope about the spindles and the packages. There is provided a humidity controlling means comprising gas circulation means for circulating gas through the envelope, moisture supply means for supplying moisture to the circulating gas, humidity measurement means for measuring the humidity of the gas being circulated, and control means responsive to said humidity measurement means for actuating said moisture supply means such that the atmosphere inside the envelope and in contact with yarn mounted therein can be maintained at a relatively high, controlled, humidity.

It has been discovered that the moisture level of never-dried yarn on packages can be maintained by maintaining the yarn in high humidity conditions.

DETAILED DESCRIPTION OF THE INVENTION

Figure 1:
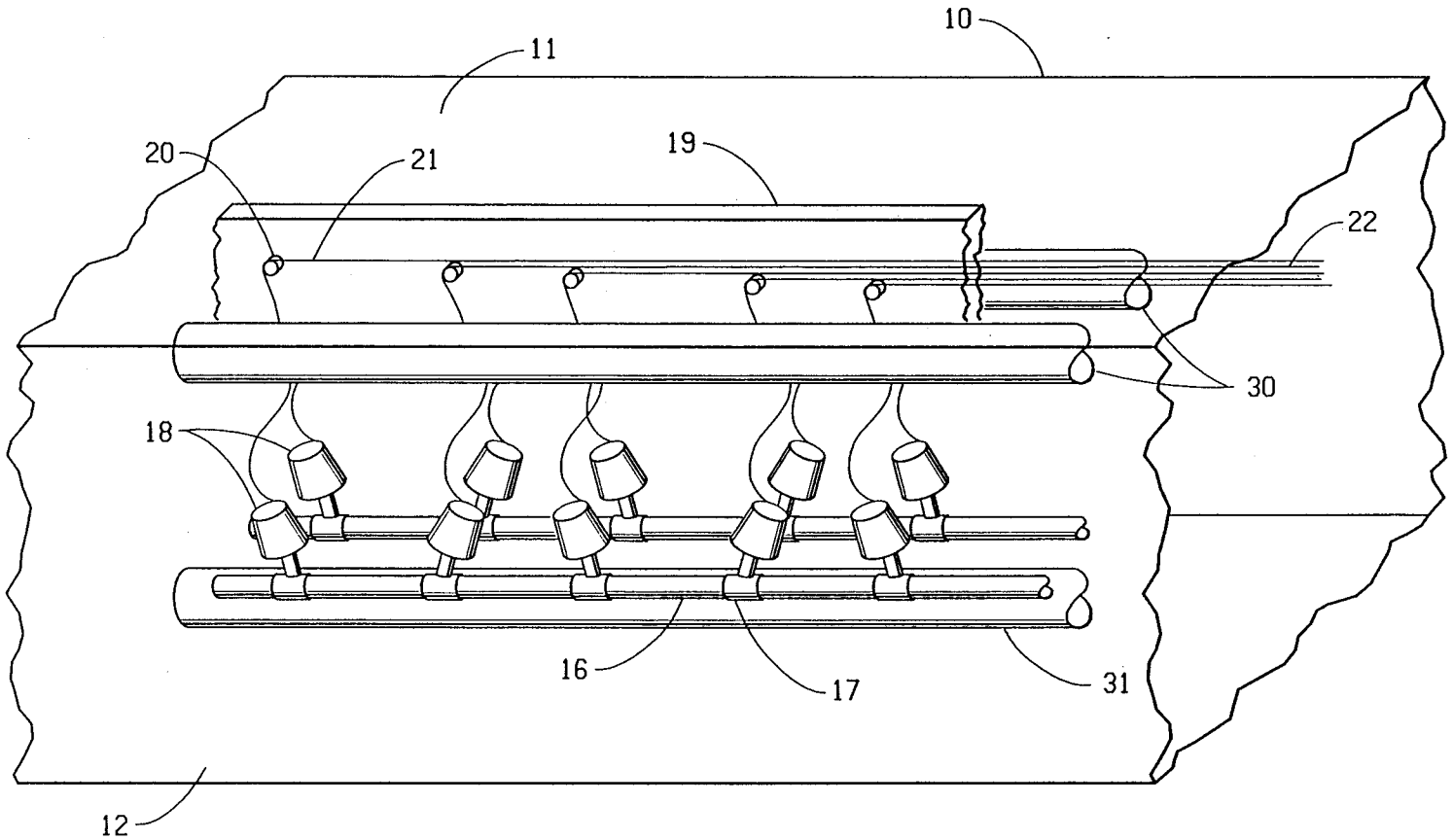
FIG. 1 is a simplified representation of the creel of this invention.

Referring now to the drawings in which like or corresponding parts are designated by like reference characters throughout the several views, FIG. 1 represents a preferred apparatus for practice of this invention.

Enclosure 10 has sides 11 and 12 (shown to be transparent) adjacent to package support means and humidity controlling means. In FIG. 1, there are shown supply pipes 30 and return pipe 31 from the humidity controlling means. Package support means includes rails 16 for holding spindles 17 on which are mounted packages 18. Packages 18 are the spools or bobbins or cones or other packages of never-dried fibers to be treated in this invention. Mounted on beam 19 above and near to spindles 17 are take-off/tensioning guides 20. Yarn 21 from packages 18 is removed from enclosure 10 over guides 20. There can be more than one rail 16—two are shown in FIG. 1—and when there are two they are generally parallel or mounted in a single plane at a slight angle. Each rail 16 can have a plurality of spindles 17 mounted such that yarn 21 can be removed easily therefrom; and each yarn 21 is guided over and past guide 20 such that the yarns 21 are removed from enclosure 10 as a warp 22.

Enclosure 10 (as well as other extended component parts of FIG. 1) is shown as broken at the ends because it can be of any, indefinite, length. The purpose of enclosure 10 is to contain a humid atmosphere and enclosure 10 can, therefore, also include ends and a bottom and top, as well as sides 11 and 12, if such are deemed desirable as useful.

Figure 2:
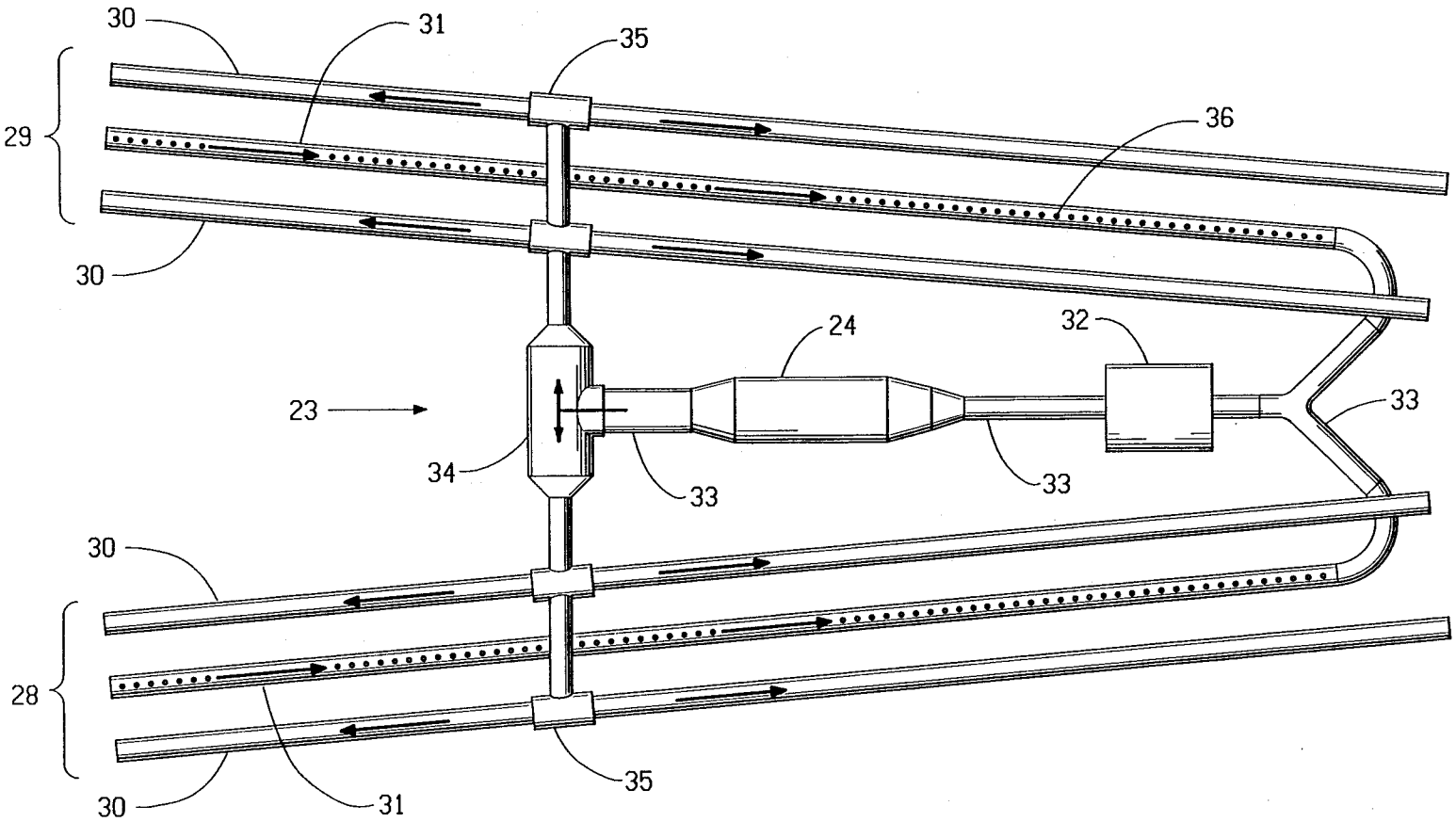
FIG. 2 is a simplified representation of the humidity controlling means of this invention.
Figure 3:
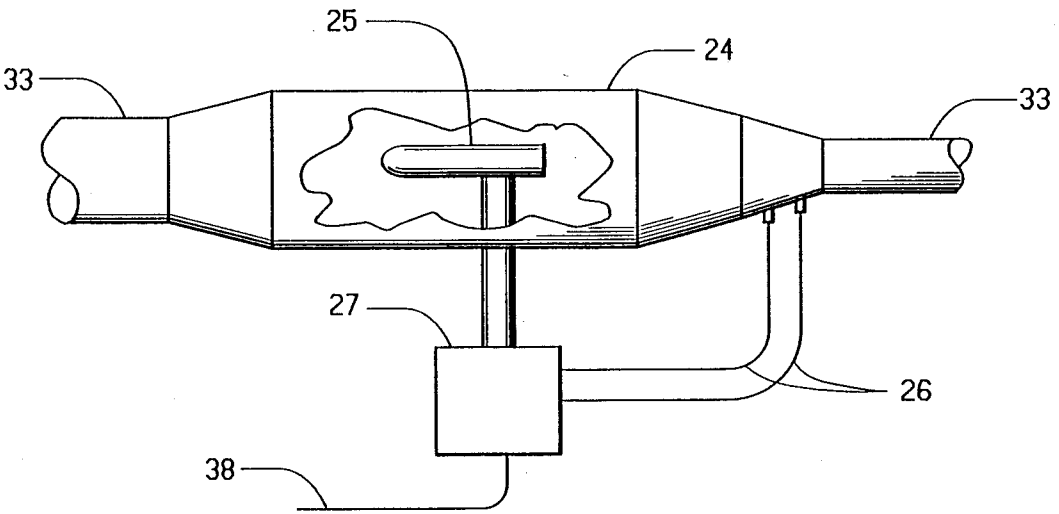
FIG. 3 is a simplified representation, in partial section, of the humidity center which includes moisture supply means, humidity measurement means, and control means.

Referring to FIG. 2 and 3, the humidity controlling means includes gas circulation means 23 with humidity center 24. Humidity center 24 includes moisture supply means 25, humidity measurement means 26, and control means 27 mounted in operative relation thereto. Gas circulation means 23 includes sections 28 and 29 each of which have two supply pipes 30 and one return pipe 31. In operation, the humidified gas in gas circulation means 23 is forced, by blower 32 mounted in main leg 33, through humidity center 24, through distribution tee 34, and to manifolds 35. The humidified gas is then conducted into supply pipes 30 and into the enclosure through perforations (not shown) in the surface of supply pipes 30. Supply pipes 30 are preferably mounted above the package support means and the perforations are preferably in the bottom portion of the surface of the pipes. Gas is returned from the enclosure to gas circulation means 23 through perforations 36 in the surface of return pipes 31. Return pipes are preferably mounted under the package support means. That gas is drawn through main legs 33 and passed into humidity center 24. In humidity center 24, the relative humidity of the gas is determined by the humidity measurement means 26 using, for example, wet bulb and dry bulb temperature readings. An indication of the relative humidity of the gas is sent to control means 27 and, if the relative humidity is indicated to be less than a predetermined minimum, water from line 38 is conducted to moisture supply means 25 and is injected into main leg 33 to humidify the gas. In this way, the atmosphere in the creel enclosure is maintained at a high, predetermined, relative humidity. It has been found that an effective and preferred means for injecting moisture into main leg 33, is to use an ultrasonic mist generator as moisture supply means 25.

This invention is directed especially toward the use of para-aramid fibers, particularly poly(p-phenylene terephthalamide) (PPD-T). PPD-T and fibers therefrom can be made in accordance with Blades, U.S. Pat. No. 3,869,429, issued Mar. 4, 1975. Other fibers can, of course, be used in practice of this invention; and, in fact, this invention can be used for any fibers which must be fed to a process in a form which requires some controlled amount of moisture.

This invention is particularly useful in maintaining moisture on yarn prior to heat treatment. One example of such a heat treatment is disclosed in above-mentioned European Patent Application 247,889.

In the practice of the process disclosed in that European Patent Application, yarn would be, customarily, supplied on packages to a creel having a MOY of about 35±5% water and it has been discovered that that MOY can be maintained if the relative humidity in the creel enclosure is controlled to about 90 to 99% at ambient temperature. Flow of the atmosphere through the creel enclosure is adjusted to maintain that humidity at that temperature.

As a general rule in the treatment of never-dried yarns, it is preferred that the yarns be kept at a MOY higher than that at which complete consolidation of the polymer structure occurs. It is generally believed that the MOY should be maintained at greater than about 20%, based on dry weight of the yarn, for p-aramid yarns.

The atmosphere in the creel is, generally, air with water; but if desired or required for some particular purpose, the air could be replaced by some other gas such as nitrogen or argon or the like.

DESCRIPTION OF THE PREFERRED EMBODIMENTS

Feed yarns for the following examples were made in accordance with the procedures described in the above-mentioned European Patent Application.

Three feed yarns of poly(p-phenylene terephthalamide) were used in the following examples. As-spun properties of those yarns are provided in Table 1, below.

TABLE 1

| Yarn # | Denier | Inh. Vis. (g/dl) | Tenacity (gpd) | Modulus (gpd) |
|---|---|---|---|---|
| A | 400 | 5.5 | 26.5 | 550 |
| B | 1150 | 5.4 | 26.7 | 530 |
| C | 1435 | 5.4 | 26.5 | 520 |

EXAMPLE 1

The feed yarn identified, above, as Yarn #B was subjected to a heat treating process as described in the above-mentioned European Patent Application. A warp composed of 48 ends of the yarn was heat treated in a 40 foot (12.2 meter) oven at 650° C., 135 yard per minute (123 m/m), and under a tension of 2.2 grams per denier (gpd). The yarn residence time in the oven was about 6 seconds. The oven was electrically heated and the yarns were heated primarily by radiant heat, and, only partially by convective heat. The oven was continuously purged with nitrogen preheated to oven temperature. The yarn leaving the oven was advanced by a set of water-cooled rolls on which the yarn temperature was reduced to about 25° C.

The yarns supplied for conduct of the heat treatment were positioned on the spindles of a creel of this invention and were maintained, before the heat treatment, in the humidified creel of this invention in an atmosphere of air at a relative humidity of 90 to 99%. As a comparative test, feed yarns from the same spinning run were heat treated as supplied from an unhumidified creel.

As an indication of the improvement provided by the present invention, it was noted that the yarns supplied from the unhumidified creel were non-uniform in color along the length, varying from dark gold to dark brown indicating variable decomposition and non-uniform yarn properties, while the yarns supplied from the humidified creel of this invention remained uniformly dark gold in color.

A major benefit provided by the present invention resides in the decreased yarn breakage which occurs during the subsequent yarn treatment when this invention is used on the feed yarns. In subsequent treatments, the packages of never-dried yarns may be mounted on the creel for 6 or as long as 8 hours until completion of the treatment. During that time, there is serious loss of moisture and increase in yarn breakage without the benefit of this invention. Counts of remaining, unbroken, yarns (ends) were made for several runs (at least ten runs in all cases) of the creel set-ups of 48 yarns; both, with the humidified creel of this invention, and with the unhumidified creel. Results of those counts are presented in Table 2, below.

TABLE 2

| Creel Set-up | Ends at Start | Ends in 2 Hrs. | Ends in 4 Hrs. | Color at 2 Hrs. |
|---|---|---|---|---|
| With Enclosure | 48 | 44* | 41* | Dark Gold |
| Without Enclosure | 48 | 28* | 8* | Dark Brown |

*Values are an average of at least ten creel set-ups.

The feed yarns were supplied to both set-ups with an initial MOY of 35%. Each of the runs continued for about six hours and, at the end of six hours, the creel set-ups without the enclosure, had yarns with a MOY of only about 20%. On the other hand, the MOY for yarns in the humidified creel of this invention maintained their initial MOY of 35% throughout the runs.

EXAMPLE 2

The other feed yarns (identified as Yarn #A and C, above) were, also, heat treated in the oven of Example 1, above. The treatment temperature and the treatment tension were maintained the same as in Example 1; but the heating time was modified in accordance with the different yarn deniers. Yarn #A was heated for about 3.6 seconds and Yarn #C was heated for about 6.7 seconds. Yarn #B was, as treated from Example 1.

All of the heat treated yarns were tested for optical defects using a yarn defect inspecting device called a Lindly Ultra II Yarn Inspector, Model 2070, sold by Lindly and Co., Inc., Mineola, NY. To test for defects, the yarn to be tested is run through the inspecting device with the aim of detecting protrusions from the main thickness of the yarn. The number of protrusions is taken to be an indication of the number of defects in the yarn under test. The defect level is reported as the number of defects per 5000 yards inspected; and the yarn which was inspected in each case of this example, was the last of the yarn to be heat treated in the run. Defect levels for all of the Yarns with and without the enclosure of this invention are reported in Table 3, below.

TABLE 3

| Yarn # | Defect Level (#/5000 yards of yarn) |
|---|---|
| A | |
| With Enclosure | 85* |
| Without Enclosure | 650 |
| B | |
| With Enclosure | 180 |
| Without Enclosure | 1120 |
| C | |
| With Enclosure | 190 |
| Without Enclosure | 1400 |

*These values are an average of at least five complete tests wherein 5000 yards of yarn were inspected.

I claim:

1. Controlled humidity creel apparatus for maintaining a high yarn moisture content during unwinding comprising:
   - package support means comprising a spindle for supporting a yarn package for unwinding;
   - enclosure means for providing a partial envelope about said package on said package support means and about a portion of the yarn adjacent said package being unwound, said enclosure means partially isolating the atmosphere within said envelope from ambient conditions outside of said envelope; and
   - humidity controlling means comprising:
     - a supply pipe mounted above the package support means for introducing gas and moisture into said enclosure means, a return pipe mounted under the package support means for receiving gas and moisture from said enclosure means, a main leg connecting said return and supply pipes, and a blower in said main leg for circulating gas and moisture received from said return pipe into said supply pipe;
     - moisture supply means mounted in the main leg for supplying moisture to said circulating gas;
     - humidity measurement means mounted in the main leg upstream from the moisture supply means for measuring the humidity of the gas being circulated through said enclosure means;
     - control means responsive to said humidity measurement means for actuating said moisture supply means when the humidity measured by said measurement means is below a predetermined level whereby the humidity level of the gas within said enclosure is maintained at or above said predetermined level.

2. The apparatus of claim 1 wherein said moisture supply means comprises an ultrasonic mist generator.

3. The apparatus of claim 1 wherein said predetermined humidity level is above about 90% relative humidity.

4. The apparatus of claim 3 wherein said predetermined humidity level is from about 90 to 99% relative humidity.

5. The apparatus of claim 1 wherein the package support means comprises a plurality of spindles for supporting a plurality of yarn packages for unwinding, said spindles being arranged for unwinding of said packages with yarn being unwound to form a warp.

* * * * *